United States Patent [19]

Gurr et al.

[11] 4,050,385

[45] Sept. 27, 1977

[54] HIGH CAPACITY PASSENGER TRANSPORT APPARATUS

[75] Inventors: Robert H. Gurr, Los Angeles; Roger E. Broggie, Carmel, both of Calif.

[73] Assignee: Walt Disney Productions, Burbank, Calif.

[21] Appl. No.: 617,437

[22] Filed: Sept. 29, 1975

[51] Int. Cl.[2] ..... B61B 11/00

[52] U.S. Cl. ..... 104/173 ST; 104/28; 104/87; 104/89; 104/178; 105/329 S; 297/184

[58] Field of Search ..... 104/173, 26 R26 B, 27, 104/28, 87, 88, 89, 91, 96, 112, 172 S, 178, 241, 18, 20, 162; 105/150, 329 S, 329 SC; 297/184, 217, 240

[56] References Cited

U.S. PATENT DOCUMENTS

| | | | |
|---|---|---|---|
| 2,682,838 | 7/1954 | Dumur | 104/87 X |
| 3,118,392 | 1/1964 | Zimmerman | 104/88 |
| 3,174,438 | 3/1965 | Hariton | 104/88 |
| 3,541,962 | 11/1970 | Avery | 104/20 X |
| 3,605,632 | 9/1971 | Furrer | 104/178 |
| 3,662,691 | 5/1972 | Goirand | 104/87 X |
| 3,675,588 | 7/1972 | Gaynor | 104/173 |
| 3,858,518 | 1/1975 | Nyman | 104/88 |
| 3,937,147 | 2/1976 | Szent-Miklosy, Jr. | 104/88 X |
| 3,948,186 | 4/1976 | McCaul | 104/162 |

FOREIGN PATENT DOCUMENTS

| | | | |
|---|---|---|---|
| 797,531 | 10/1968 | Canada | 104/173 |

*Primary Examiner*—Albert J. Makay
*Assistant Examiner*—Randolph A. Reese
*Attorney, Agent, or Firm*—Fulwider, Patton, Rieber, Lee & Utecht

[57] ABSTRACT

There is disclosed a high capacity passenger transport apparatus which may be employed as a ski lift including a high speed main cable ascending up a ski run and driven at high speeds. A pair of first and second shuttle tracks lead from the downhill run of such cable at the bottom station and separate to pass through respective first and second loading areas and then merge back together at the uphill run of the high speed cable. Chair trucks are carried on the main cable and include releasable grippers gripping such cables and are intercepted at the end of their downhill travel by escort cars which decelerate such trucks and escort them past a selector switch to direct alternate ones thereof onto the respective first and second shuttle tracks and then to a stopped position at the loading area so skiers can be loaded thereonto. The escort cars are then accelerated to accelerate such trucks along the respective shuttle tracks to be fed alternately onto the uphill run of such cable at a speed synchronized with the speed of such cable to grip such cable and be carried rapidly therealong for deposit at the uphill station. If desirable, the uphill station may likewise include first and second unloading shuttle tracks for receiving alternate trucks for deceleration to a stop at respective separate first and second unloading areas and then re-acceleration for deposit on the downhill run of the high speed cable. Further, the chairs themselves are preferably formed with back walls which pivot away carrying the seats therewith to clear a skier's path from the rear of such chairs so the skier may approach the chairs from the rear and after positioning relative to such chairs, the back walls and seats carried thereon pivoted back into position so the skier may be seated for conveyance up the ski run.

13 Claims, 7 Drawing Figures

TO CAR
EXIT FROM CAR

HIGH CAPACITY PASSENGER TRANSPORT APPARATUS

BACKGROUND OF THE INVENTION

1. Field of the Invention

The high capacity passenger transport apparatus of the present invention relates to a device for transporting passengers rapidly from one point to another, such as from the bottom of a ski run to the top thereof.

2. Description of the Prior Art

With the present day increasing popularity of recreational skiing, numerous different ski lift devices have been proposed for conveniently transporting a high rate of skiers up a ski run in relative comfort and with relative ease. Such efforts have led to the provision of high speed trams wherein 100 and even more skiers may be loaded into a single tram car and transported up the ski run at a rapid rate. Another very common form of transporting skiers up a slope is the provision of a plurality of independent chairs suspended from an endless cable supported above the terrain by support posts for conveyance of the skiers up the slope as the endless cable is advanced. Devices of this type suffer the shortcoming that the rate at which skiers can be transported up the slope is limited by the rate at which such skiers can be loaded at the bottom of the hill and unloaded at the top of the hill. Consequently, even though chair lifts of this type may have a high theoretical capacity rating, the true rating thereof may be far below such theoretical rating thereof because of the human limitation on loading and unloading rate, as further complicated by the unfortunate requirement that operation of such chair must be periodically suspended when a skier falls during loading or unloading thereof, a situation occurring much more frequently as the chair speed is increased. Further, any time a passenger without skis is to be unloaded from one of such chairs, advancement of the cable itself must be stopped, thus interrupting the transportation of skiers up the run. Those familiar with modern day ski areas will readily appreciate the numerous other instances wherein chairs must be stopped, as for instance for the loading of ski patrol tobaggans thereon for transportation up the hill, or for the loading of other equipment and necessities for transportation up the chair.

Efforts to overcome these shortcomings have led to the provision of gondolas which are also suspended from cables similar to that just described except that the gondolas themselves are suspended from trucks which may grip the cable for advancement therewith and which may be fed onto low speed tracks located at the bottom and top of the hill so such gondolas may be brought to a halt for loading and unloading of four to six passengers. Commonly, such gondolas are decelerated upon release from the main cable and after loading are reaccelerated to synchronize their speed with the main cable before being fed thereonto. Ski lifts incorporating chairs suspended from trucks of the type just described have also been proposed so such chairs may themselves be slowed down substantially for loading and unloading to thus enable the main cable to be operated at a higher rate of speed. Devices of this type have been installed at the ski resort at Mt. Snow, Vt. Ski lifts of this general type suffer the shortcoming that the capacity thereof is still restricted by the rate at which skiers may be loaded onto the chairs at the bottom of the hill and unloaded therefrom at the top of the hill. Consequently, even though the main cable may be operating at a high rate of speed, due to the inherent limitations in loading and unloading rate, the chairs will be spaced apart relatively great distances on the main cable, thus seriously limiting the number of skiers that may be transported up the run during any selected period of time.

SUMMARY OF THE INVENTION

The high capacity passenger transport apparatus of the present invention is characterized by a high speed main cable leading from a loading station to an unloading station. A pair of first and second shuttle tracks are provided at the loading station and lead from the return run of such cable to separate first and second boarding stations and then lead back to the transport run of the high speed cable. Chairs are suspended from the high speed cable by means of trucks including gripper means releasably gripping such cable and encountering a divider at the loading station to divide the trucks between the first and second shuttle tracks, such trucks engaging escort means which slow such trucks upon approaching the respective loading stations and then reaccelerate such trucks and feed them back onto the main cable at a speed synchronised with the speed of such main cable. If desirable, the chairs themselves may face sideways to the direction of travel of the high speed cable and may be brought to a full stop at the loading stations and opened from the back side thereof to provide a direct ski path along which a skier may approach the respective chairs from the rear thereof to enable such chairs to be closed behind the skiers to bring the seat portions thereof into position for the skier to sit thereon.

The objects and advantages of the present invention will become apparent when taken in consideration with the following detailed description of the drawings.

DESCRIPTION OF THE PREFERRED EMBODIMENT

Figures 1, 2, 3:
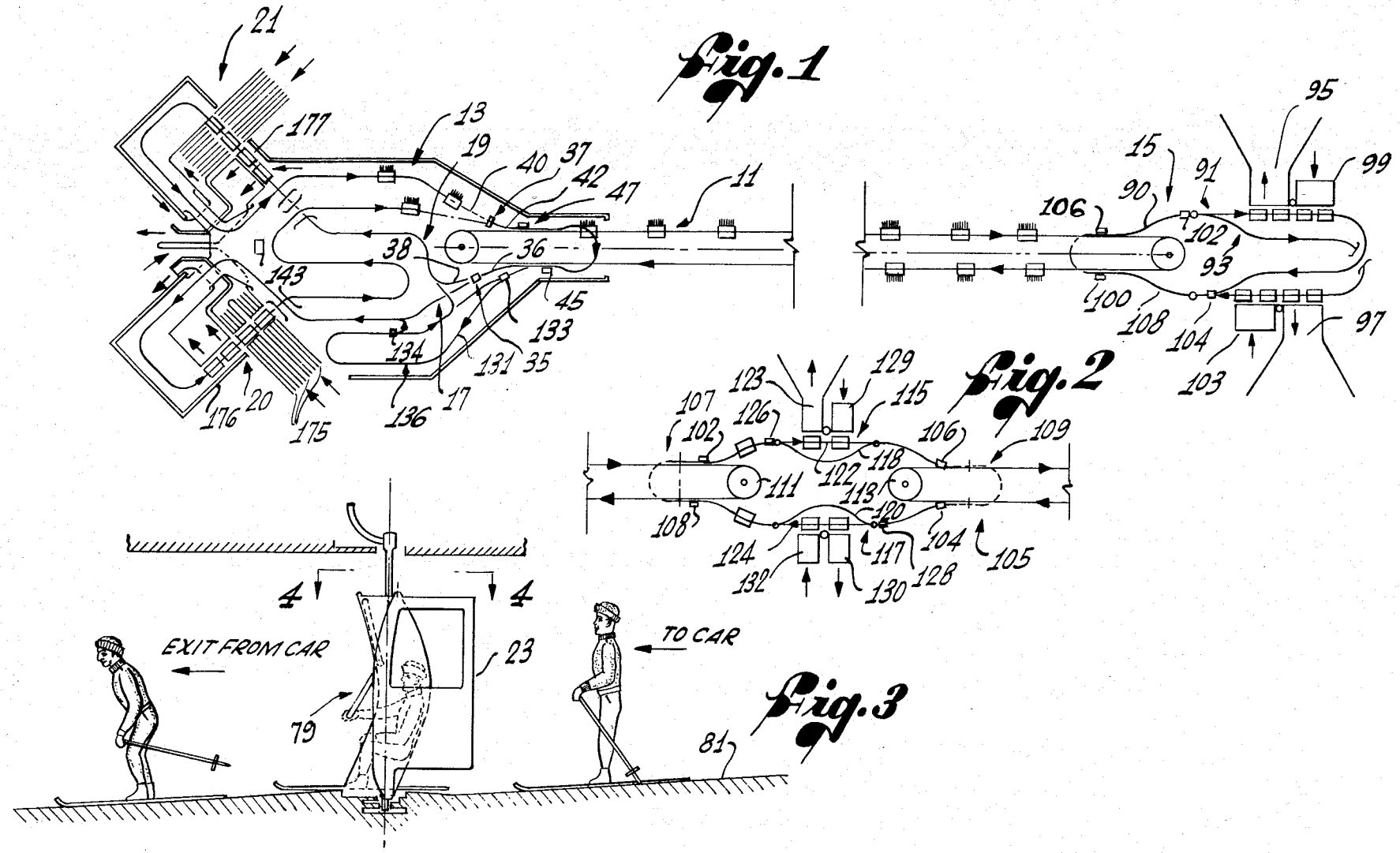
FIG. 1 is a broken top plan view of a high capacity passenger transport apparatus embodying the present invention.
FIG. 2 is a top plan view of a mid-station which may be incorporated in the high capacity passenger transport apparatus shown in FIG. 1.
FIG. 3 is a side elevational view of a lower loading station, in enlarged scale, included in the high capacity passenger transport appartus shown in FIG. 1.
Figure 6:
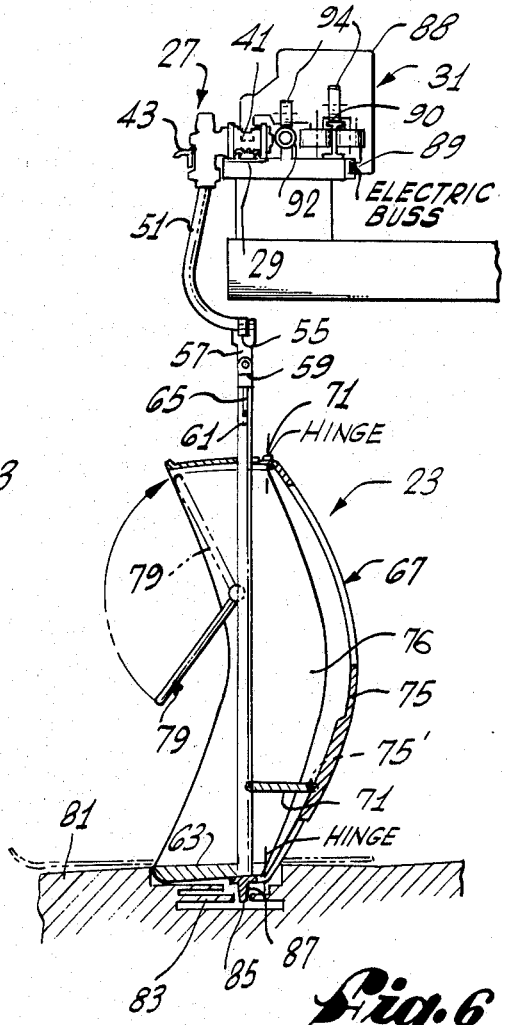
FIG. 6 is a transverse sectional view taken along the line 6—6 of FIG. 5.

The high capacity passenger transport apparatus of the present invention may be in the form of a ski lift which includes, generally, high speed endless cableway 11 leading from a bottom station 13 to a top station 15. The bottom station includes a pair of first and second shuttle tracks, generally designated 17 and 19, which lead from the downhill run of such high speed cable-way 11 and separate to lead to respective first and second loading areas 20 and 21. From such loading areas, the tracks then lead back to a merger point disposed adjacent the uphill run of the high speed cable 11. Referring to FIG. 6, a plurality of rear entry chairs, generally designated 23, are carried from respective trucks 27 which ride along rails 29 and are escorted therealong by means of individual escort cars 31. Referring to FIG. 1, a selector switch 35 alternates truck 27 between the first and second shuttle tracks 17 and 19 and a dispatch switch, generally designated 37, receives the trucks 31 alternately from the first and second shuttle tracks 17 and 19 to feed them onto the uphill, or transport, run of the high speed cable 11. Consequently, the high speed cable 11 may be run at a relatively high rate of speed and the chairs 23 themseleves brought to a stop at the respective loading areas 20 and 21 for convenient loading thereof and then accelerated by means of the escort cars 31 to synchronize the speed thereof with the speed of the cable 11 before gripping thereof during their uphill travel.

Figure 5:
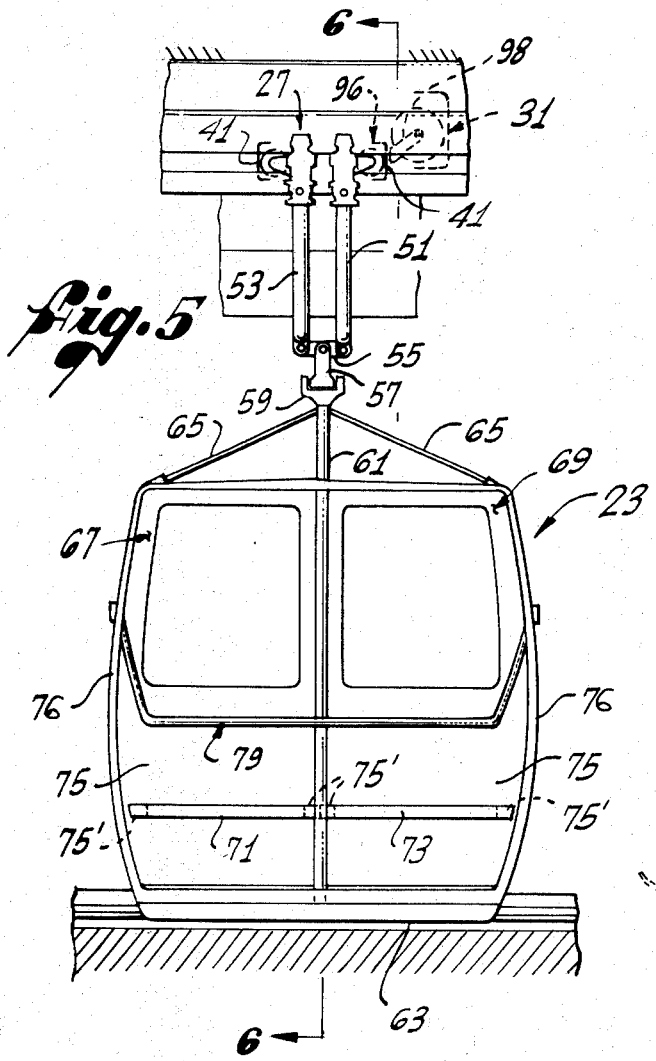
FIG. 5 is a front view, in enlarged scale, of a chair included in the passenger transport apparatus shown in FIG. 1.

Referring to FIGS. 5 and 6, it will be appreciated that the chairs 23 are suspended from the cable 11 and also from the shuttle tracks 17 and 19 in an orientation sideways to the direction of travel whereby the skier faces outwardly away from the support posts normally disposed between the uphill and downhill runs of the high speed cable 11. For the particular installation shown, the length and vertical drop of the ski run dictate the necessity of breaking the cable-way up into at least two separate cables, as to be described hereinafter, in connection with FIG. 2, and the trucks 27 are fed from the loading shuttle tracks 17 and 19 onto the uphill run of the lowermost length of the cable-way 11. Referring to FIG. 1, the shuttle tracks 17 and 19 form a rather circuitous route as dicatated by the convenience of the topology and architectural layout thereof, such tracks receiving the downhill traveling trucks 27 onto a common intercept track 36 which feeds onto the first shuttle track 17 and which cooperates with a knife edge articulated track section 38 of the second shuttle track 19 controlled by the selector switch 35 to pick every second truck off the interceptor track 36. Likewise, as the shuttle tracks 17 and 19 merge at the dispatch switch 37 an articulated track section 40 of the second shuttle track 19 is controlled by such dispatch switch to alternately feed cars from such shuttle track onto the merger track 52 for dispatch onto the uphill run of the cable-way 11.

In this regard, the trucks 27 include wheels 41 riding on the shuttle support rails 29 and grippers actuated by a gripper lever 43 which engages a gripper release 45 located adjacent the common shuttle track 36 leading to the shuttle tracks 17 and 19 to release such gripper from the main cable 11 during downward travel thereof and subsequently engages a gripper actuator 47 located adjacent the common merger track 42 leading from such first and second shuttle tracks 17 and 19 as it approaches the upward run of such cable-way 11 to actuate such gripper and cause it to grip the cable. The gripper and gripper release and actuator 45 and 47, respectively, may be of the type commonly utilized in gondola ski lifts.

The chairs 23 are conveniently suspended from the trucks 27 by means of a pair of arcuate suspension tubes 51 and 53 (FIGS. 5 and 6) connected together on their lower extremity by means of a cross link 55 having a suspension yoke 57 pivotally supported therefrom and, itself, pivotally supporting a yoke 59, to thus form a universal joint for suspension of such chair.

Figure 4:
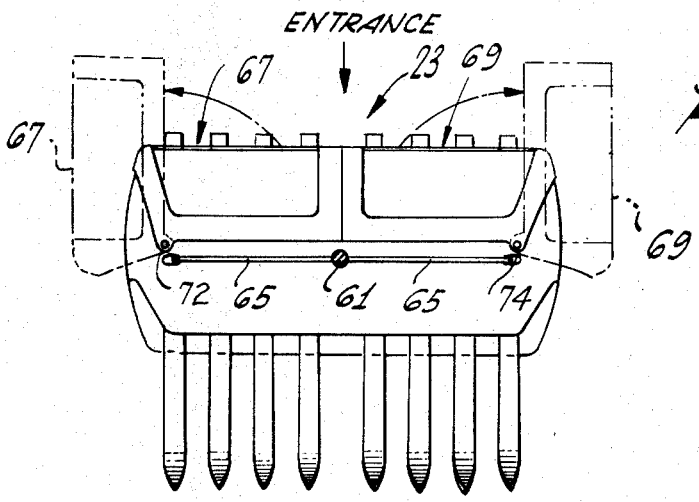
FIG. 4 is a horizontal sectional view, in enlarged scale, taken along the line 4—4 of FIG. 3.

Referring to FIGS. 4 and 6, the individual chairs 23 are then supported from a vertical post 61 carried from such yoke 59 and includes a framework formed by a floor 63 and roof suspension struts 65 which pivotally support a pair of rearwardly opening swinging gate type doors, generally designated 67 and 69 (FIG. 4) by means of respective vertically extending hinges 72 and 74. The doors 67 and 69 are formed by perpendicularly extending side walls 76 and back walls 75', the back walls being arcuate in the vertical plane as viewed in FIG. 6 and arranged to orient the passenger weight in back of the vertical center line of the suspension arrangement.

Referring to FIG. 5, respective seats 71 and 73 are pivotally carried from the respective doors 67 and 69 by means of horizontally extending hinges 75'. A U-shaped, horizontally extending arresting bar, generally designated 79, is pivotally mounted at its opposite legs from the opposite sides of the chair frame and includes a down position as shown in solid lines in FIG. 6 and a retracted unload position shown in broken lines.

Referring to FIG. 3, the loading platform 81 slopes transversely downwardly from back to front relative to the chairs 23 and is formed with a trench 83 projecting thereacross longitudinal of the shuttle track. Such trench 83 forms a guideway 85 for receipt of a stabilizing fin 87 supported from the bottom wall 63 of the chair 23 to thus stabilize such chair against front-to-back oscillation. The bottom wall 63 of such chair 23 is recessed below the level of the loading platform 81 so the rider's skis will clear such floor during loading on the chair.

The escort cars 31 include individually powered drive motors 88 (FIG. 6) which receive electrical current from shuttle track busses 89 projecting longitudinally of shuttle tracks 90 and 92 on which the escort cars 31 ride by means of support wheels 94. Referring to FIG. 5, the trucks 27 each include engagement faces 96 which are engagable by counterfacing override dogs 98 carried by the respective escort cars 31.

Referring to FIG. 1, the upper station, commonly thought of as the unloading station, includes first and second loading shuttle tracks generally designated 91 and 93, similar in construction to that of the aforedescribed shuttle tracks 17 and 19, such tracks diverging from a common receiving track 90 having a gripper release 106 disposed adjacent thereto and leading to respective first and second unloading areas 95 and 97 to which escort cars similar to the cars 31 bring the chairs themselves to a stop so skiers riding thereon may ski away in a direction generally transverse to the direction of travel along such shuttle tracks. The escort cars then advance beyond the unloading stations 95 and 97 and stop at respective loading stations 99 and 103, at which point skiers desiring to descend the hill on such chairs may be loaded and the chairs then advanced onto a merger track 108 and accelerated by means of the escort cars past a gripper actuator 100 to be fed back onto the downhill run of the high speed cable 11.

Referring to FIG. 2, a midway station, generally designated 105, is incorporated intermediately in the high speed cable 11 to provide for loading and unloading at the midway point to break such cable into upper and lower lengths of cable, generally designated 107 and 109, fed at their proximate extremities about bull wheels 111 and 113, thereby enabling a longer ski run to be served. The gripper levers 43 are actuated by means of gripper releases 102 and 104 as the trucks approach the respective lower and upper bull wheels 111 and 113 and the trucks 27 transferred between such cables by means of respective shuttle tracks 115 and 117, the gripper level 43 being actuated by respective gripper actuators 106 and 108 as the trucks 27 are transferred onto the subsequent cable 109 and 107, respectively. The tracks 115 and 117 also employ escort cars similar to the cars 31 that engage the trucks 27 after they have been released from the uphill run of the lower high speed cable 107 and from the downhill run of the upper high speed cable 109 to escort them either rapidly along respective bypass tracks 118 and 120 or slowly along respective loading tracks 122 and 124, depending on the position of respective selector switches 126 and 128 which control positioning of articulated portions of the respective tracks 118 and 120. The escort cars 31 serve to slow the trucks for unloading of skiers from the chairs 23 at respective unloading stations 123 and 130 and subsequent advancement to respective loading areas 129 and 132 to load skiers desiring to ascend the ski run from the midway point.

Referring to FIG. 1, a storage track, generally designated 131, is provided at the bottom station and travel thereto is controlled by means of a control switch 133 and travel therefrom and to the respective shuttle tracks 17 and 19 is controlled by a selector switch 134 which controls an articulated portion of such track 131 to alternate trucks between two Y-branches leading to the respective tracks 17 and 19. The escort car tracks 136 similar to the track 90 (FIG. 6) loop around to join with the beginning of the storage track 131 and the track is itself articulated so a selected number of escort cars 31 may be circulated back to the storage track and the number required for the particular speed of operation advanced therefrom and onto the track 90 employed in the shuttle tracks 17 and 19.

Figure 7:
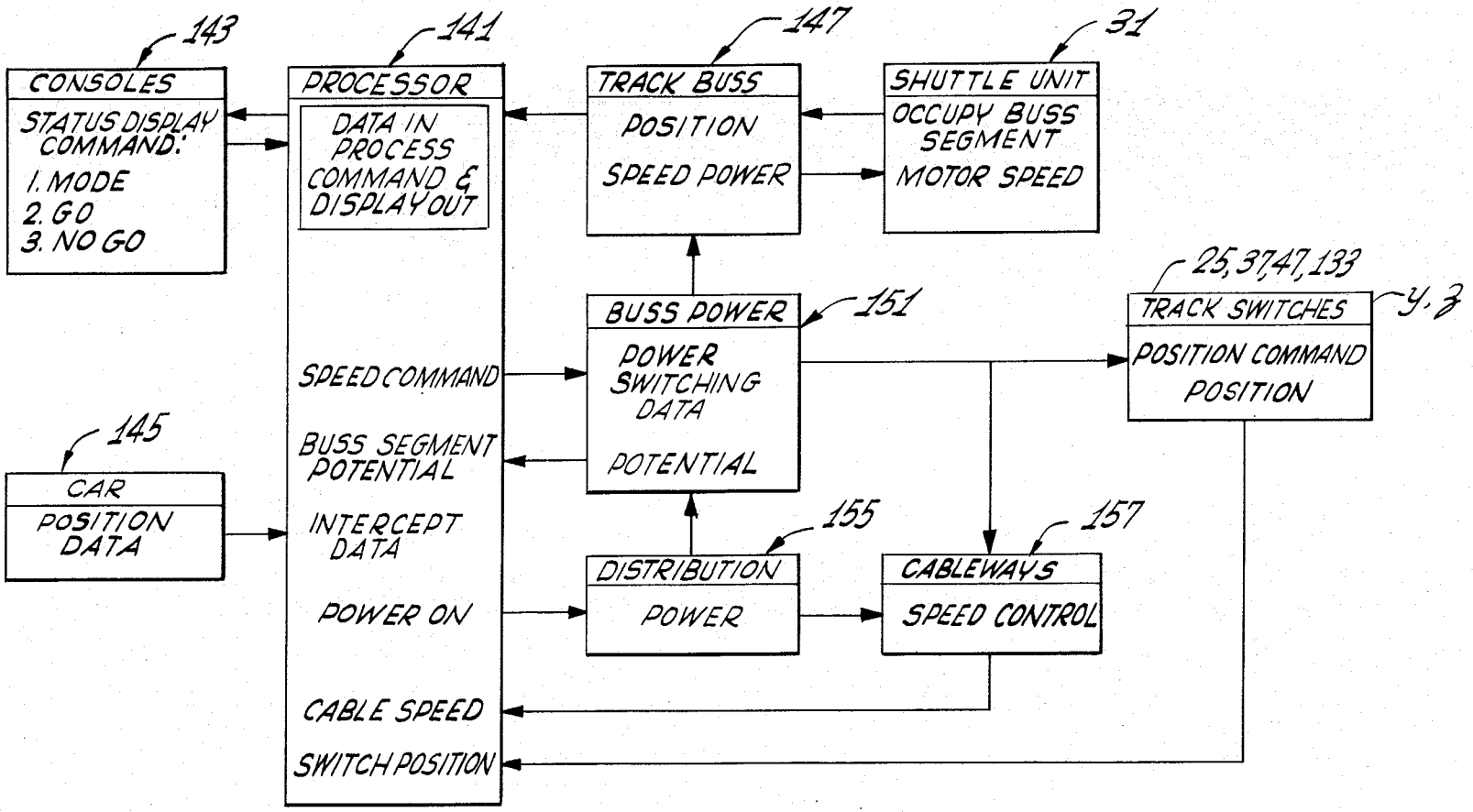
FIG. 7 is a schematic view of the high capacity passenger transport system shown in FIG. 1.

Referring to FIG. 7, operation of the disclosed passenger transport apparatus is controlled by a processor, or computer, 141 similar to that conventionally incorporated in conveyors employed in assembly line processing. The computer 141 is connected with consoles, generally designated 143, located at the lower and upper stations 13 and 15, as well as the midway station shown in FIG. 2. The control consoles 143 have various modes, as for instance running the lift at full load and full speed with all shuttle tracks 17, 19, 91 and 93 in operation, as well as providing for stopping of selected ones of the chairs at the midway loading and unloading tracks 122 and 124. In a second mode, the shuttle tracks 19 and 93 are deactuated and approximately half the chairs 23 are picked out of the system by the storage switch 133 and directed onto the storage track 131 (FIG. 1) for storage until subsequent use thereof is required.

A car position system 145 maintains constant reference to the location of each car on the shuttle tracks and on the high speed cable or in the storage area and feeds such information into the processor 141. A track buss indicator 147 is provided for sensing continuity of power on the respective busses 89 (FIG. 6) to assure continuity of electrical power along each buss and survey the location of each escort car 31 on each shuttle track.

A buss power monitoring system 151 is connected with the track buss 147 to monitor the potential at all locations along the track busses 89 and detect switching of the various control switches directing trucks to and from the respective shuttle and storage tracks. A power distribution circuit 155 is provided for supplying power to the various components and is connected with a cable-way drive 157 which drives the main high speed cable 11, it being appreciated that the processor 141 is connected with such cable-way drive to index the other activities of the system with the speed thereof, particularly during times of acceleration and deceleration.

In operation, the particular mode selected on the operator's console 143 is dictated by the passenger load to be transported up the hill and the desire, if any, to inventory greater or lesser numbers of passengers on the main cable 11 to thereby control, to some extent, the number of skiers actually descending the runs. Assuming the apparatus is to be run at full capacity, the control therefor on the console 143 is actuated to feed the corresponding information into the processor 141 and actuate all shuttle track switches 35, 37, 102 and 104 to bring all shuttle tracks 17, 19, 91 and 93 into operation. Assuming further that the majority of skiers on that particular day elect to bypass the midway station shown in FIG. 2 and continue on to the top of the mountain to the top unloading station 15, the switches 122 and 128 are rendered operable to normally direct the chair trucks 27 along the bypass tracks 118 and 120 and directly onto the joining main high speed cables 107 and 109, thus normally bypassing the midway station.

Assuming all chairs 23, after their previous run as on the previous day, have been stored on the storage track 131, such chairs would be advanced therefrom with the switch 134 (FIG. 1) directing alternate chairs to the shuttle tracks 17 and 19 to be routed to the respective loading areas 20 and 21. Respective escort cars 31 engage and couple themselves to the individual trucks 27 as they are advanced onto the shuttle tracks 17 and 19 to convey the chairs 23 at a speed dictated by the processer 141 to cause adjacent chairs on such respective shuttle tracks to be paired up in convoys at the loading area 20, it being appreciated that such chairs face generally downhill at the loading areas 20 and 21.

Referring to FIG. 3, the arresting bar 79 is in its lowered position and the back opening doors 67 and 69 are swung to their open, broken line positions, shown in FIG. 4, and the seats 71 (FIG. 6) raised to clear a path from the rear of such chair for an approaching skier 171 (FIG. 3) skiing down a slight loading area incline 81. It will be appreciated that opening and closing of the doors 67 and 69 may be controlled manually, or by commonly known linkages and, if desired, may be opened automatically as the chairs approach the loading stations 20 and 21. Referring to FIG. 6, it will be appreciated that the stabilizing fins 87 serve to stabilize the chairs against oscillation and swinging, thereby holding such chairs steady as the skier approaches and strikes the arresting bar 79.

Referring to FIG. 1, it will be noted that the arrangement of two double chairs 23 at the respective loading stations 20 and 21 will receive a total of eight lines 175 of skiers moving forward four abreast to enter the chairs 23 from the rear thereof and strike the arresting bars 79. The rearwardly opening doors 67 and 69 are then closed and the seats 75 (FIG. 6) simultaneously lowered so the individual skiers may then sit down. After the short pause for loading, the escort cars 31 escorting the convoyed pair of chairs 23 advances such chairs along the respective shuttle tracks 17 and 19 to be accelerated separately to break up the convoy pairs and approach the speed of the cable-way 11. The accelerated trucks 27 are automatically uncoupled from the escort cars 31 and are fed past the merger switch 37 and onto the high speed cable 11 from which the gripper 43 is actuated by the gripper actuator 47 to grip the high speed cable 11 for transport up the ski run.

The individual escort cars 31 then continue on around the shuttle track loop and intercept the respective trucks 27 of chairs 23 returning on the downhill run of the cable 11 and releasably lock thereonto by means of the locking dog 96 (FIG. 5) and decelerate such trucks to pass the selector switch 35 directing alternate cars to the shuttle track pairs 17 and 19. The decelerated cars are then advanced along the respective shuttle tracks to respective loading areas 176 and 177 immediately preceding the respective loading areas 20 and 21 where such cars 31 stop the trucks 27 to enable a ride operator to raise the arresting bat 79 and passengers to disembark. The escort cars 31 then advance the respective trucks 27 to suspend the chairs 23 in convoy pairs in the loading areas 20 and 21 for loading thereonto of four skiers for each loading area 20 and 21 and the process then repeated.

Referring to FIG. 1, meanwhile the chairs 23 being conveyed up the cable-way 11 will pass the midway station shown in FIG. 2 as described hereinafter to continue on to the top unloading area 15. The trucks 27 approaching such unloading area will engage their respective gripper actuator levers 43 (FIG. 6) with the gripper release 106 to release the respective grippers to free such truck for travel along a receiving track 90 as escorted by cars similar to the escort car 31. Such trucks are escorted past a selector switch 102 controlling an articulated section of a shuttle track 91 to transfer every second car thereonto, thus leaving the alternate cars on the receiving track 90 to be fed onto a second shuttle track 93. The chairs 23 are then paired up in convoy pairs and advanced to respective unloading areas 95 and 97 where they are brought to rest so skiers riding therein may, after the arresting bar 79 is raised (FIG. 3), disembark and ski away from a downhill run. The escort cars 31 will then advance the chairs to the respective upper loading stations 99 and 103 to enable any skiers electing to descend the hill on such chairs to be loaded thereonto. It will be appreciated that the riders will merely walk into the closed chairs 23 from the front thereof, be seated and lower the arresting bars 79, rather than approaching from the rear as in the case of the skiers at the bottom loading station 13. The respective escort cars 31 will then accelerate the individual trucks 27 of the respective convoy pairs from the respective loading areas 99 and 103 at different speeds to separate such pairs and feed such trucks past the selector switch 104 and alternately onto the merged shuttle track 108. The escort cars 31 continue accelerating the truck 27 as to the speed of the cable-way 11 and dispatches them thereonto and past the gripper actuator 100 actuating the respective gripper levers 43. The individual chairs 23 will then continue down the downhill run to repeat the procedure described hereinabove while the escort cars 31 continue on around the shuttle loop.

It will be appreciated that as different skiers passing the respective bottom and top station consoles 143 request unloading at the midstation shown in FIG. 2, the operator will select the appropriate mode to cause the trucks being escorted along the midstation shuttle tracks 115 and 117 to be stopped at the respective midstation unloading ramps 123 and 130. It is noted that in the normal mode the trucks 27 are normally merely transferred between the lower and upper cables 107 and 109 along the respective bypass tracks 118 and 120. However, as the selected ascending truck 27 engages the gripper release 102 it is directed along the shuttle track 115 past the selector switch 124 which switches the bypass track 118 to direct such truck on the uphill unloading track 122. The escorting car 31 then brings the truck to a rest at the unloading ramp 118 to enable the skiers to unload therefrom. The individual chairs 23 are then advanced to the loading area 129 to enable skiers desiring to ride only the upper high speed cable 109 to load thereonto. The escort cars 31 then continue the trucks 27 on their way by escorting them along the shuttle track 115 to pass a gripper actuator 106 which actuates the gripper levers 43 to cause the individual truck grippers to grip the cable 109.

Similarly, the selected individual chairs 23 descending on the upper high speed cable 109 will engage the gripper release 124 and be released to be escorted along the downhill shuttle track 117 past the selector switch 128 which switches the bypass track 120 to direct the trucks suspending such chairs 23 onto the unloading track 124. Such chairs are brought to a rest at the unloading station 130 to enable skiers to ski thereaway from and is then advanced to a loading station 132 from where skiers may be loaded thereonto. The cars 23 then continue their downhill trip and are fed onto the downhill run of the lower high speed cable 107 to be carried past the gripper actuator 108.

It will be appreciated that any time the lines 175 become sufficiently short to no longer justify operating both the loading shuttle tracks 17 and 19 and both unloading shuttle tracks 91 and 93, the appropriate mode may be selected at the console 143 to discontinue operation, for instance, of the loading shuttle track 19 and the unloading shuttle track 93. Thereafter, the selector switch 35 will direct all descending cars onto the shuttle track 17 for conveyance progressively through the unloading area 176 and loading area 20 to be fed back onto the uphill run of the high speed cable 11. At the top of the hill, such chairs 23 will be fed onto the unloading shuttle track 91 for progression through the unloading and loading stations 95 and 99 and, finally, return to the downhill run of the high speed cable 11. Since a fewer number of chairs 23 will be required in this mode of operation, the storage switch 133 will operate to selectively transfer selected ones of the chairs 23 from the cable-way 11 and onto the storage track 131 for storage.

For ski terrains justifying even higher capacities, the number of shuttle tracks may be increased as desired and the main cable 11 either run at higher speeds or the individual chairs spaced closer together therealong. Thus, the necessity of constructing numerous different lifts for serving the same ski trails is eliminated and the necessity of standing in long serpentine lines at the bottom of the hill which skiers now find so distasteful is reduced. Further, it will be apparent that since the skiers are loading onto stationary chairs, the danger of such skiers falling during the loading operation is practically eliminated, thereby eliminating the down time normally associated with such a fall, as well as eliminating the risk of injury to the skier. Finally, since the chairs themselves are stopped at the loading stations 20 and 21, any cargo, such as ski patrol tobaggans or supplies, may conveniently be loaded thereon, without interfering with normal passenger transporting operations.

Various modifications and changes may be made with regard to the foregoing detailed description without departing from the spirit of the invention.

We claim:

1. High capacity passenger transport apparatus comprising:

endless high speed cable means including a cable running from a loading to an unloading station and having transport and return runs and means for driving it at high speed;

intercept means for intercepting trucks from said return run;

a plurality of chair trucks including releasable gripper means for selectively gripping said high speed cable and, truck support means;

a plurality of loading station shuttle tracks at said loading station for receiving truck support means of said trucks intercepted by said intercept means to transport them to respective spaced apart loading areas and then to the transport run of said high speed cable and including means for feeding said trucks sequentially into said high speed cable transport run;

a plurality of chairs suspended from said respective trucks, including frames and respective back walls pivotally mounted from said frames for being pivoted away to clear a through path from the rear of said chairs, said chairs further including seats mounted from said walls;

gripper release means for engaging said releasable grippers to release said grippers from said high speed cable as said trucks feed onto said respective shuttle tracks;

gripper actuation means to activate said grippers as said trucks are fed onto said transport run;

selector means for intercepting chair trucks from said high speed cable and directing them sequentially onto each shuttle track of said plurality of shuttle tracks; and loading escort means for engaging said trucks as they are received on said shuttle tracks, advancing said trucks along said shuttle tracks at a relatively low speed to said respective loading areas and then back to said transport run of said high speed cable to feed said trucks sequentially from each shuttle track of said plurality onto said high speed cable means whereby said high speed cable may be run at a higher speed than said shuttle drive means and said trucks may be fed sequentially from the shuttle tracks onto said cable means to position the suspended chairs in spaced relationship on said cable for advancement thereof with said high speed cable means.

2. High capacity passenger transport apparatus as set forth in claim 1 wherein:

said cable means includes first and second pairs of spaced apart bull wheels, first and second endless cables threaded around said respective pairs of wheels;

bypass tracks leading between runs of said first and second cables traveling in the same direction; and escort cars for escorting said trucks along said bypass track.

3. High capacity passenger transporting apparatus as set forth in claim 1 wherein:

said escort means includes escort tracks and buss bars extending coextensive with said shuttle tracks and escort cars riding on said escort tracks and including individual electric motors, brushes carried by said cars contacting said buss bars and control means for controlling the speed of said individual escort cars.

4. High capacity passenger transport apparatus as set forth in claim 1 wherein:

said escort means includes speed control means for bringing said trucks to a stop at said loading areas;

said chairs include chair frames and back wall means pivotally mounted on said frames for being pivoted away to clear a path from the rear of said chairs; and respective seats mounted on said back walls.

5. High capacity passenger transport apparatus as set forth in claim 4 wherein:

said chairs are suspended from said trucks to be normally disposed facing transversely to the direction of displacement thereof.

6. High capacity passenger transport apparatus as set forth in claim 4 wherein:

said chairs include respective arresting bars projecting transversely thereof and shiftable between a lowered position for contact therewith upon loading said chairs and raisable to a retracted position clearing a passenger pathway leading from said respective chairs.

7. High capacity passenger transport apparatus as set forth in claim 1 wherein:

said escort means includes speed control means for bringing said trucks to a stop at said loading areas.

8. A passenger transport apparatus comprising:

high speed cable means;

low speed shuttle track means leading from said high speed cable means;

escort means for escorting said trucks along said shuttle track at low speed;

trucks receivable on said high speed cable means and transferable to said shuttle track means;

chair frames suspended from said respective trucks;

chair backs pivotally mounted from said frame and including seats mounted thereon, said backs being operable to pivot open and form a passenger pathway leading therethrough; and arresting means mounted from said pathway and normally disposed in said pathway whereby said trucks may be transferred from said high speed cable means onto said low speed shuttle tracks to slow the rate of travel of said chairs and said backs thereof opened to form a pathway for receipt of passengers.

9. High speed passenger transport apparatus as set forth in claim 8 wherein:

said chairs include respective arresting bars projecting transversely thereof and shiftable between respective lowered positions for contact therewith by a passenger upon loading said chairs and raisable to respective retracted positions clearing passenger pathways leading from said respective chairs.

10. High speed passenger transport apparatus as set forth in claim 8 wherein:

said chairs are suspended from said trucks to be normally disposed facing transversely to the direction of displacement thereof.

11. High speed passenger transport apparatus as set forth in claim 8 wherein:

said chair seats are pivotally mounted from said respective chair backs.

12. High speed passenger transport apparatus as set forth in claim 8 wherein:

said chair backs each include a pair of back walls for each chair and rigidly connected oppositely disposed side walls, said side walls being pivotally carried from the opposite sides of said respective chairs.

13. A passenger transport chair for suspension from a transport cable and comprising:

a chair frame including at least one side member disposed on one side of a passenger pathway;

a back wall pivotally mounted at its outer extremities and pivotable from said side member;

a seat carried from said back wall; and an arresting bar carried from said side member and operative to shift between a lowered position in said pathway and a raised positon clear of said pathway whereby said back walls may be pivoted to their open position to open said pathway for advancement therealong of a passenger to said arresting bar and said back walls then closed to bring said seats into position for passengers to be seated thereon.

* * * * *